US010451390B2

(12) United States Patent
Pendleton et al.

(10) Patent No.: US 10,451,390 B2
(45) Date of Patent: Oct. 22, 2019

(54) GRAVITY RESETTING RANGE TARGETS AND HIGH VISIBILITY HIT INDICATORS

(71) Applicant: Revolution Targets, LLC, Loganville, GA (US)

(72) Inventors: Bruce Pendleton, Loganville, GA (US); Gordon Pendleton, Loganville, GA (US)

(73) Assignee: Revolution Targets, LLC, Loganville, GA (US)

( * ) Notice: Subject to any disclaimer, the term of this patent is extended or adjusted under 35 U.S.C. 154(b) by 0 days.

(21) Appl. No.: 15/896,636

(22) Filed: Feb. 14, 2018

(65) Prior Publication Data

US 2019/0249963 A1 Aug. 15, 2019

(51) Int. Cl.
*F41J 7/04* (2006.01)
*F41J 5/18* (2006.01)

(52) U.S. Cl.
CPC .. *F41J 7/04* (2013.01); *F41J 5/18* (2013.01)

(58) Field of Classification Search
CPC ..... F41J 7/04; F41J 1/10; F41J 5/18
USPC ..... 273/390–392, 407
See application file for complete search history.

(56) References Cited

U.S. PATENT DOCUMENTS 687,873 A * 12/1901 Daniels ..... F41J 7/04 273/390
1,310,415 A * 7/1919 Isberg ..... F41J 7/04 124/26
1,569,781 A * 1/1926 Orr ..... F41J 7/04 273/392
1,733,606 A * 10/1929 Junker ..... A63F 9/02 273/371
2,085,933 A * 7/1937 Vaughan ..... F41J 7/04 273/388
2,113,719 A * 4/1938 Creswell ..... F41J 7/04 273/386
D143,838 S 2/1946 Marr
D164,166 S 8/1951 Griswold
2,777,695 A * 1/1957 Cohn ..... F41J 7/04 273/386
3,506,266 A * 4/1970 Wintersteen ..... A63B 63/00 124/36

(Continued)

OTHER PUBLICATIONS

Office Action, dated Mar. 14, 2018, from corresponding U.S. Appl. No. 15/687,459.

(Continued)

*Primary Examiner* — Mark S Graham
(74) *Attorney, Agent, or Firm* — Brient IP Law, LLC

(57) ABSTRACT

Gravity resetting range targets include rotatable target plates that rotate around a rotation axis extending through a fixed target body. The rotatable target plates rotate 360 degrees around the rotation axis and through a target plate aperture of the fixed target body, resetting to a ready position using gravity forces acting on the weight of the rotatable target plates. High visibility hit indicators include long-range hit indicators rotatably mounted to the fixed target body opposite the rotatable target plate such that the long-range hit indicator rotates around the rotation axis substantially 180 degrees from the rotatable target plate. The rotatable target plates are cut from the fixed target bodies within a single piece of material and remain connected via tabs until assembly is desired.

18 Claims, 17 Drawing Sheets

(56) References Cited

U.S. PATENT DOCUMENTS

| | | | | |
|---|---|---|---|---|
| 3,814,429 | A * | 6/1974 | Lienhard | A63B 63/06 273/127 D |
| D261,667 | S | 11/1981 | Griggs | |
| 4,540,182 | A | 9/1985 | Clement | |
| 5,176,386 | A | 1/1993 | Simmons | |
| 5,277,432 | A | 1/1994 | Bateman | |
| D387,412 | S | 12/1997 | Borrows | |
| 5,788,245 | A * | 8/1998 | Hada | A63F 9/0204 273/392 |
| D479,423 | S | 9/2003 | Mahoney | |
| D493,056 | S | 7/2004 | Shornak | |
| 6,779,797 | B1 * | 8/2004 | Chou | F41J 7/04 273/391 |
| 6,994,349 | B2 | 2/2006 | Lambert et al. | |
| 7,128,321 | B1 * | 10/2006 | Brown | F41J 5/18 273/392 |
| 7,175,181 | B1 * | 2/2007 | Bateman | F41J 7/04 273/392 |
| D557,541 | S | 12/2007 | Corbell | |
| 7,422,216 | B1 | 9/2008 | Underhill | |
| D643,500 | S | 8/2011 | Sanders | |
| 8,534,672 | B2 | 9/2013 | Brune | |
| 8,807,570 | B1 * | 8/2014 | Zalar | F41J 7/04 273/390 |
| 8,910,943 | B2 | 12/2014 | Lee | |
| D724,176 | S | 3/2015 | Maestas | |
| D744,058 | S | 11/2015 | Dee | |
| D750,727 | S | 3/2016 | Dee | |
| D775,309 | S | 12/2016 | Newman | |
| D787,628 | S | 5/2017 | Hammons et al. | |
| D815,241 | S | 4/2018 | Woller | |
| 10,030,944 | B1 | 7/2018 | Miller | |
| 10,088,279 | B2 | 10/2018 | Hoy, Jr. | |
| 2011/0024985 | A1 | 2/2011 | Potterfield et al. | |
| 2011/0074110 | A1 | 3/2011 | Markley | |
| 2015/0330748 | A1 | 11/2015 | Anzalone | |
| 2016/0195369 | A1 | 7/2016 | Perry et al. | |
| 2016/0327378 | A1 * | 11/2016 | Davis | F41J 5/205 |
| 2017/0184378 | A1 | 6/2017 | Fernandez | |
| 2018/0087881 | A1 | 3/2018 | Bickel | |
| 2018/0299232 | A1 * | 10/2018 | Thompson | F41J 1/10 |
| 2019/0025016 | A1 * | 1/2019 | Schroedel | F41J 1/10 |

OTHER PUBLICATIONS

Do-All Outdoors Bio Fusion Handgun Spinner Steel Fusion Target, posted at Amazon, question posted Aug. 31, 2017. Site visited Apr. 10, 2019. URL: https://www.amazon.com/Do-All-Outdoors-Handgun-Spinner-Caliber/dp/B00RPE5BKI (Year: 2017).

DuraSeal Interlocking Octagon Targets, posted at Target Barn, posting date not available. Site visited Apr. 10, 2019. URL: https://www.targetbarn.com/targets-duraseal-interlocking-octagon-spinner-44892-champion.php#product-qa.

Quick Draw Pistol Target, posted at Sportsman's Guide, posting date Feb. 15, 2017. Site visited Apr. 10, 2019. URL: https://web.archive.org/web/20170215171300/https:/www.sportsmansguide.com/product/index/quick-draw-pistol-target?a=2067327 (Year: 2017).

Self Resetting Air Gun Tumbler Target, posted at Amazon, posting date Mar. 2, 2017. Site visited Apr. 10, 2019. URL: https://www.amazon.co.uk/dp/B06XCWLJSG/ref=asc_df_B06XCWLJSG%201554220800000/?tag=idex-21&creative=22374&creativeASIN=B06XCWLJSG&linkCode=dfO, (Year: 2017).

Steel on Target, Review: AMSEC Gravity Spinning Bullseye Target with Torso Target follow up, posted at YouTube, posting date Aug. 3, 2016. Site visited Apr. 10, 2019. URL: https://www.youtube.com/watch?v=HMIoQta3EiA (Year: 2016).

Office Action, dated Apr. 15, 2019, from corresponding U.S. Appl. No. 29/637,165.

* cited by examiner

GRAVITY RESETTING RANGE TARGETS AND HIGH VISIBILITY HIT INDICATORS

BACKGROUND

Shooting firearms is an activity that often involves considerable training and practice on firearm ranges that are created to provide a safe environment for shooting. Law enforcement and military personnel, as well as recreational shooters, train extensively at ranges that provide numerous types of range targets designed to provide shooters with something to aim at before shooting and to provide feedback as to the accuracy of the resulting shot. Conventional targets include metal disks or surfaces that may be mounted on a base. These targets are manufactured in processes that are traditionally inefficient and create substantial waste product.

When shot, a conventional target may fall backwards or to the ground, providing feedback to the shooter that the target was hit. The target must then be manually reset into place for the next shot. This process is cumbersome and time consuming. There are targets that may be reset by pulling a rope or device, using electronic or pneumatic mechanisms, or shooting at a reset target. However, these types of resetting targets all require additional hardware and additional steps or actions to reset the targets before shooting again. When shooting long-range targets, not only is resetting a target problematic, but visually identifying the result of the shot is challenging. Traditionally, when firing at a long-range target, the shooter or a spotter would need optics to determine whether or not the shot was on-target.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Concepts and technologies described herein provide for gravity resetting range targets and high visibility hit indicators, and manufacturing the same. According to one aspect, a gravity resetting range target includes a fixed target body and a rotatable target plate. The fixed target body has a target plate aperture, which defines the shape of the rotatable target plate. The rotatable target plate is coupled to the fixed target body so that the rotatable target plate is able to rotate around a rotation axis that extends through the fixed target body.

According to yet another aspect, a method for providing a gravity resetting range target is provided. The method includes providing a single piece of material. A fixed target body and a rotatable target plate is cut from the single piece of material. Cutting the rotatable target plate results in a target plate aperture that is shaped and sized to allow for a minimal clearance between the rotatable target plate and the fixed target body when the rotatable target plate is positioned within the aperture. The rotatable target plate is rotatably mounted to the fixed target body so that the rotatable target plate rotates around a rotation axis extending through the fixed target body and through the target plate aperture in response to receiving an impact with a projectile.

According to another aspect, a method for providing a shooter with a target and shot feedback is provided. The method includes providing a fixed target body having a target plate aperture. A rotatable target plate is shaped according to the target plate aperture and is rotatably coupled to the fixed target body. The rotatable target plate is configured to rotate around a rotation axis that extends through the fixed target body.

The features, functions, and advantages that have been discussed can be achieved independently in various embodiments of the present disclosure or may be combined in yet other embodiments, further details of which can be seen with reference to the following description and drawings.

DETAILED DESCRIPTION

Figure 1:
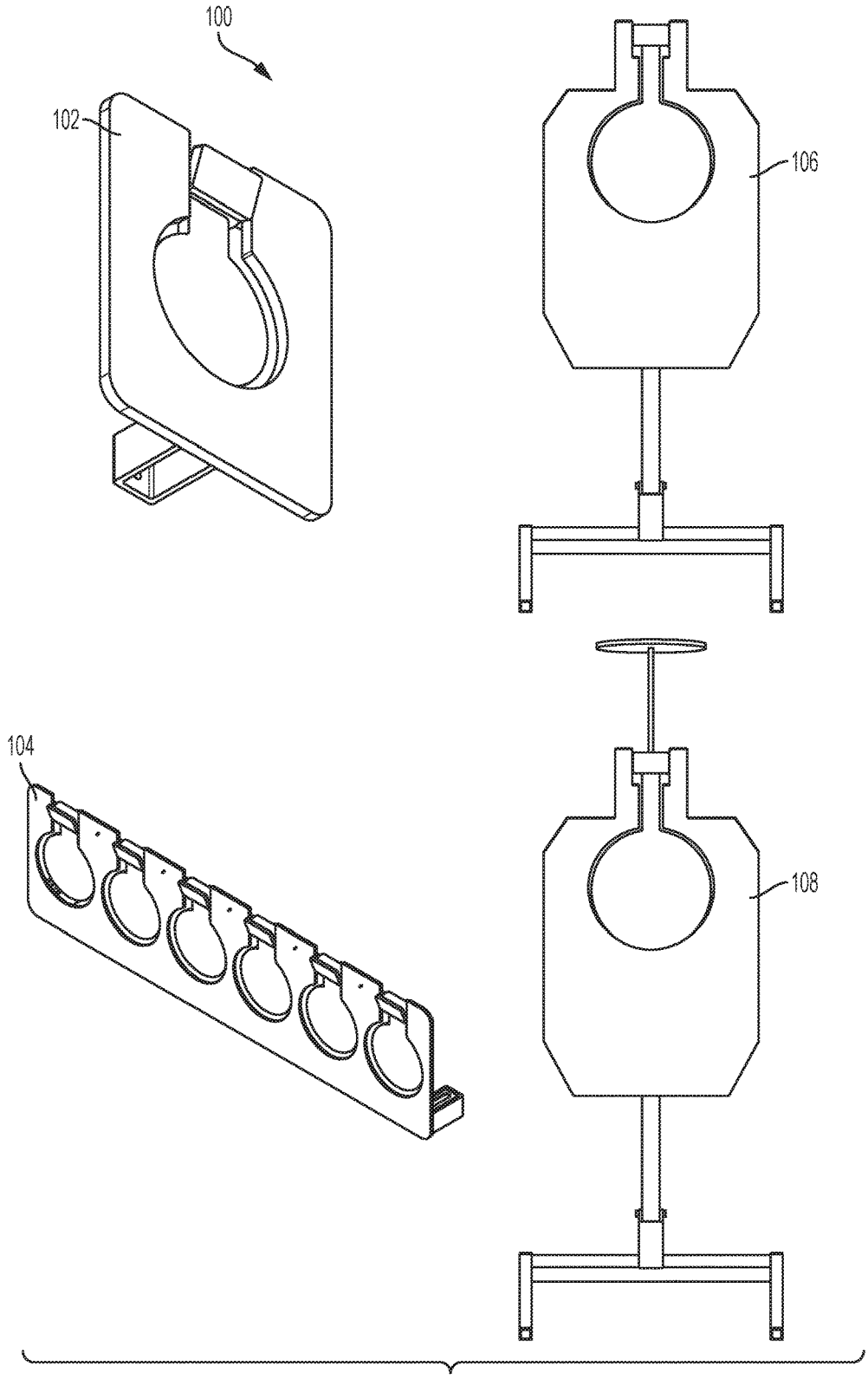
FIG. 1 shows front and perspective views of different types of range targets according to various embodiments described herein.

The following detailed description is directed to gravity resetting range targets with and without high visibility hit indicators that aid in providing hit feedback without the use of optics. In addition, the following detailed description is directed to an efficient method of manufacturing a gravity resetting range target using a single sheet of material. As discussed above, a conventional range targets are designed to fall backwards when hit, or even entirely disconnect from a support frame and fall to the ground. Resetting conventional targets requires some type of manual, electronic, or pneumatic process that is cumbersome, costly, and/or time consuming. A hit or miss determination after a long-range shot on a conventional range target is often difficult to determine without using optics.

Moreover, manufacturing conventional range targets involves stamping or cutting circular targets from sheets of metal or suitable material, while bending, stamping, or cutting frame or support components from other metal pieces. Due to the circular or unusual shape of many targets, there is a lot of waste material left over after cutting the targets from a sheet of material.

However, utilizing the concepts and technologies described herein, gravity resetting targets are provided for that are each cut from a single piece of material to increase efficiency and decrease waste. The gravity resetting range targets described below are gravity resetting, requiring no additional steps, materials, or systems to prepare them for the next shot. The various embodiments of range targets may include a long-range hit indicator that rotates downward into view after a corresponding plate target is hit with a projectile, and then around a rotation axis so that visually distinctive features of the long-range hit indicator repeatedly rotate in and out of view. In doing so, a shooter is visually aware of a target hit at long range without the use of optics or spotters.

In the following detailed description, references are made to the accompanying drawings that form a part hereof, and which are shown by way of illustration, specific embodiments, or examples. Referring now to the drawings, in which like numerals represent like elements through the several figures, gravity resetting range targets and long-range hit indicators according to the various embodiments will be described.

FIG. 1 shows four examples of gravity resetting range targets 100. These four examples will be described in detail below. While the various embodiments will be discussed with respect to these four examples of gravity resetting range targets 100, the various concepts and technologies disclosed herein are not limited to implementations in these four configurations. Rather, the various concepts and technologies described herein are applicable to any gravity resetting range targets 100 having the features described in the specification and claims below.

FIG. 1 shows examples of a plate target 102, a rack target 104, a torso frame target 106, and a long-range torso frame target 108. All of these examples show portable range targets that may be easily transported, assembled, set up at a desired location, moved as desired, and disassembled. For illustrative purposes, the plate target 102 and the rack target 104 are shown without bases, while the torso frame target 106 and the long-range torso frame target 108 are shown in assembled states with bases attached. It should be appreciated that all of the gravity resetting range targets discussed herein may be assembled with bases and disassembled as desired. The bases and corresponding assembly and disassembly process will be described below.

The plate target 102 provides a single target plate for a shooter in a compact form that may be easily transported and positioned by a single person. The plate target will be described in detail with respect to FIGS. 2 and 3. The rack target 104 provides one or more shooters with the same features as the plate target 102, but with multiple targets in a single housing, or fixed target body, that is easily transported and positioned by a single person. The rack target 104 will be discussed below with respect to FIG. 4.

The torso frame target 106 provides the same target features as the plate target 102, but with the target encompassed by a fixed target body that represents a human torso. Law enforcement and military personnel, in particular, benefit from training with the torso frame target 106 to accurately hit center mass of a torso. Immediate feedback of an accurate hit is provided by a spinning target plate, which resets to a ready position without further action from the shooter. The torso frame target 106 is described in further detail below with respect to FIG. 5.

If visualizing an accurate shot with the torso frame target 106 (or any other range target described herein) is difficult due to extreme shot distances, the long-range torso frame target 108 may be used. The long-range torso frame target 108 provides a long-range hit indicator extending above the target plate that spins with the target plate when the target plate is struck by a projectile. The long-range hit indicator includes a high-visibility feature that visually distinguishes the long-range hit indicator from the front surface of the target plate so that a successful shot will be easily visualized as the long-range hit indicator repeatedly appears and disappears from the shooter's view. This functionality allows provides the shooter with immediate feedback of a successful shot without using optics. The long-range torso frame target 108 will be described in further detail below with respect to FIGS. 6-12.

Gravity Resetting Range Targets

Figure 2:
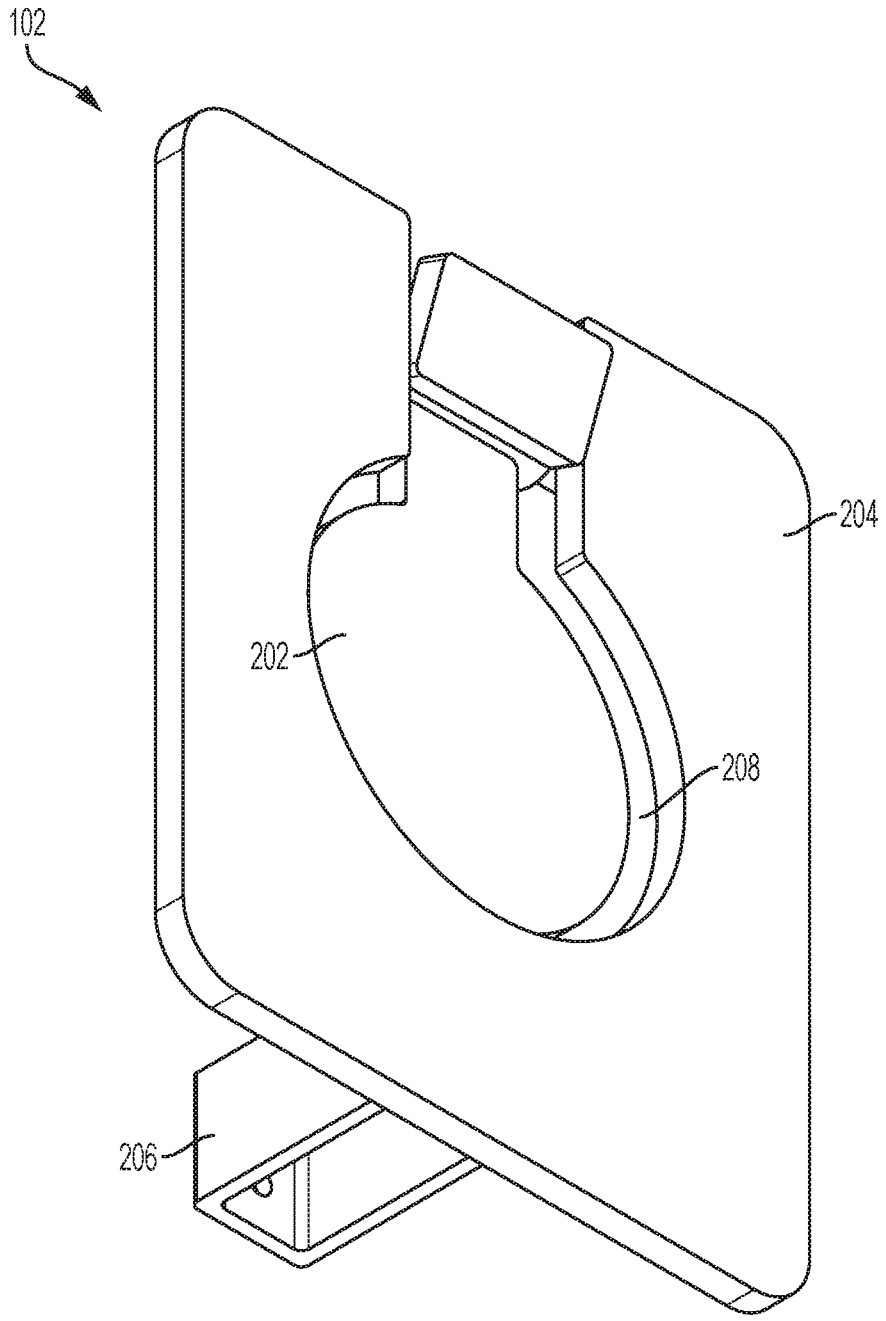
FIG. 2 is a perspective view of a plate target according to various embodiments described herein.
Figure 3:
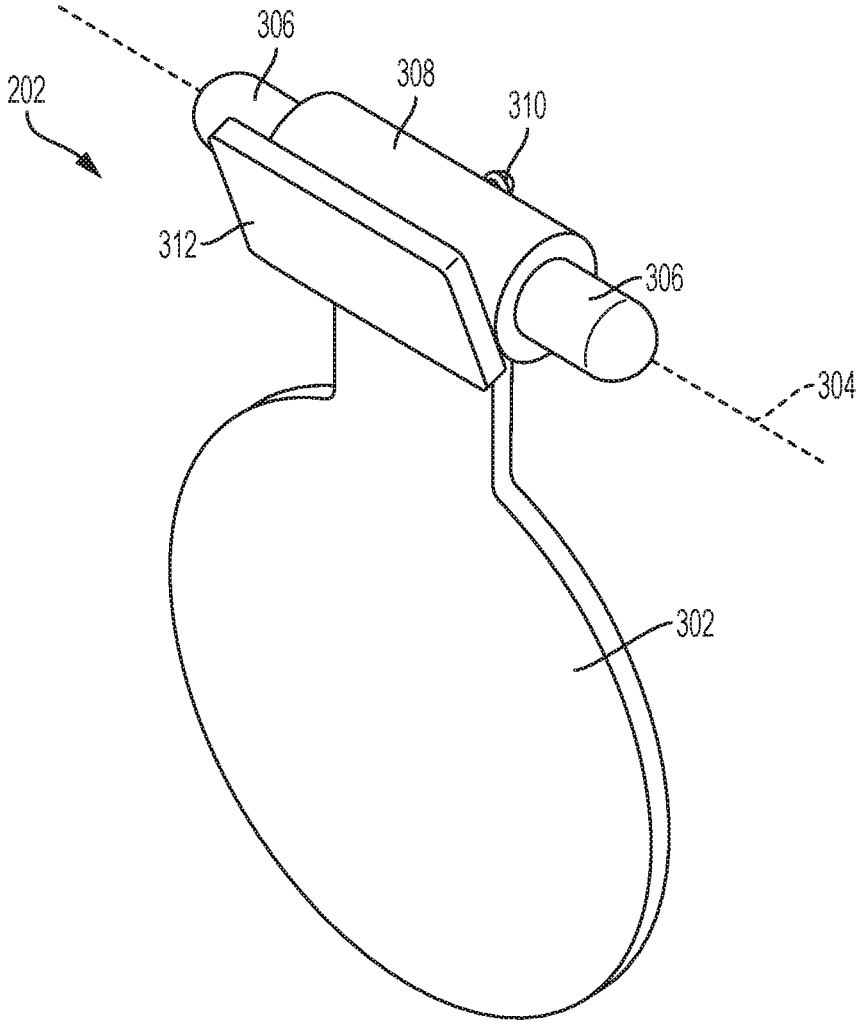
FIG. 3 is a perspective view of a rotatable target plate used within gravity resetting range targets according to various embodiments described herein.

The structure and corresponding functionality of the gravity resetting range targets 100 will now be discussed in detail. Turning now to FIGS. 2 and 3, the plate target 102 is provides a single target in a compact, portable configuration. According to this example, the plate target 102 includes a rotatable target plate 202 mounted within a fixed target body 204. The rotatable target plate 202 and the fixed target body 204 may be cut or otherwise manufactured from the same sheet of material, as discussed below with respect to FIGS. 13-16. The material may include any material suitable for impact with bullets or projectiles, including but not limited to, abrasion resistant alloy steel, stainless steel, other steel or steel alloy materials, titanium, other metal alloys or combination of metal alloys, suitable composite materials, fiberglass Kevlar® panels, Lexan® or any combination thereof. According to one embodiment, the rotatable target plate 202 and the fixed target body 204 are manufactured from AR500 steel. The rotatable target plate 202 rotates around a top portion, or any portion within the body of the plate target 102 after impact with a projectile, passing through a target plate aperture 208 with each rotation. Gravity acts on the weight of the rotatable target plate 202 to stop the rotation and reset the rotatable target plate 02 for the next shot.

Figure 8:
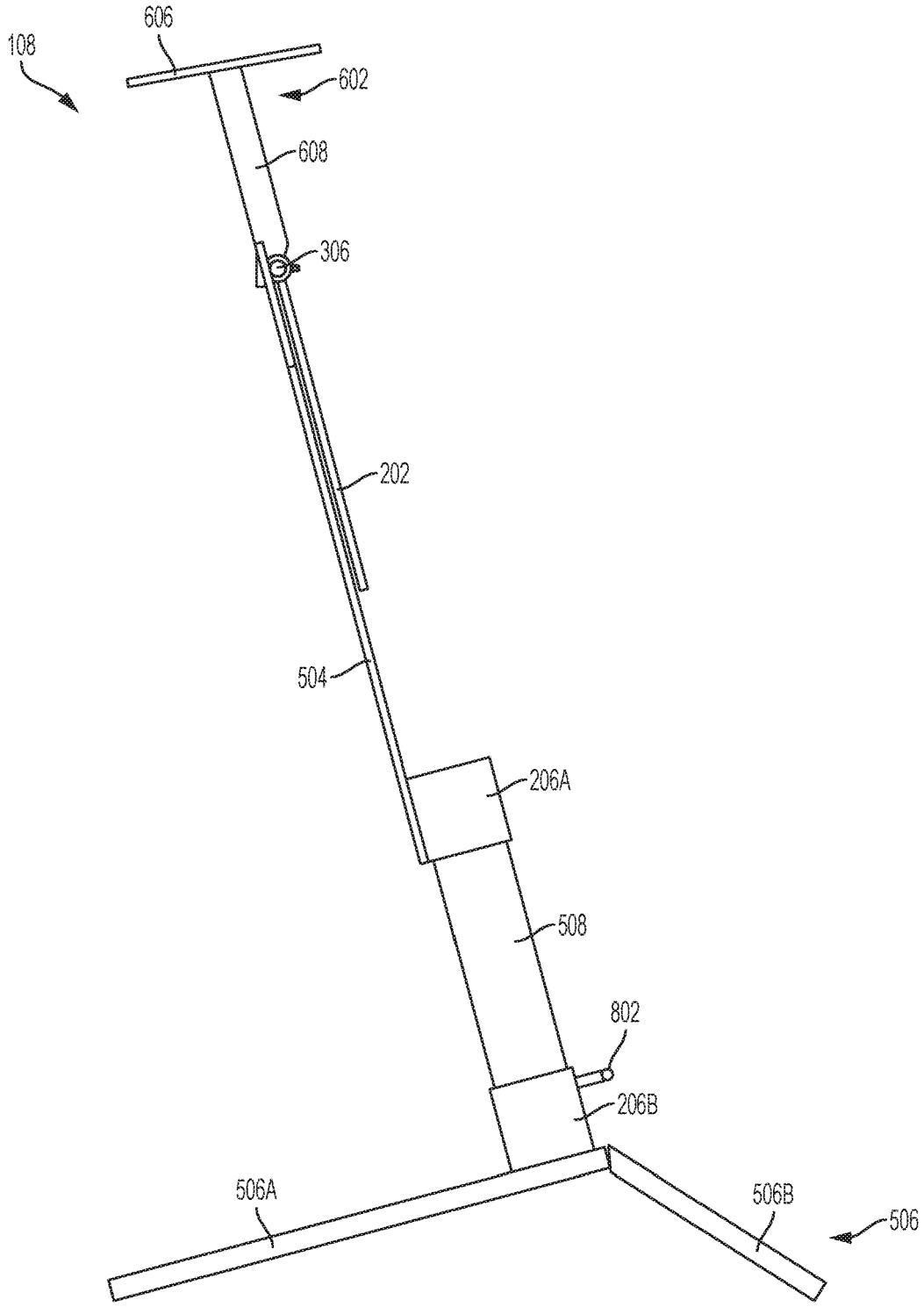
FIG. 8 is a side view of a long-range torso frame target with the target plate aligned with the torso frame body according to various embodiments described herein.

A bracket 206 may be secured to the fixed target body 204 to secure the plate target 102 to a base (as shown in FIG. 8 with respect to the long-range torso frame target 108). A metal, wood, composite, or other type of post may be used to couple the fixed target body 204 to the base, as described in greater detail below. In this manner, the plate target 102 may be disassembled for transport, creating a portable range target that is easily transported, assembled, and disassembled by a user.

FIG. 3 shows an example of a rotatable target plate 202, according to various embodiments. The rotatable target plate 202 provides the portion of the target that the shooter aims at, as well as the portion that provides feedback as to the shot success and resets for the next shot without any action required by the user. The rotatable target plate 202 is used within the plate target 102, but is also used within all of the gravity resetting targets 100 described herein.

The rotatable target plate 202 includes a front surface 302 that provides a target for the shooter to aim at. The front surface 302 may be painted any color (e.g., white, yellow) that distinguishes the front surface 302 of the rotatable target plate 202 from the front surface of the fixed target body 204 in order to provide an easily distinguishable surface at which to aim when the shooter is transitioning between targets. Moreover, by utilizing a colored or bright surface on the front surface 302 of the rotatable target plate 202 and a dark or contrasting color on the rear side of the rotatable target plate 202, the user is provided with visual feedback of a successful shot. After impact with a projectile, the rotatable target plate 202 spins around a rotation axis 304. The contrasting colors of the opposing surfaces of the rotatable target plate 202 rotate in and out of view when spinning around a rotation axis 304, providing a quick and clear visual indication that the target was successfully hit. It should be noted that although the rotation axis 304 is shown as being substantially horizontal, or parallel to the ground, the rotation axis 304 may be configured according to any non-horizontal angle with respect to the ground (e.g., at a 45 degree angle such that the rotatable target plate 202 rotates at an angle).

When mounted within the fixed target body 204 of a gravity resetting range target 100, the shaft 306 of the rotatable target plate 202 is secured to the fixed target body 204 using brackets and fasteners, welding, adhesive, or any other suitable method of fixing the shaft 306 in place with respect to the fixed target body 204. A bearing or bushing rotatably couples to the rotatable target plate 202 to the shaft 306, allowing the rotatable target plate 202 to rotate around the shaft 306 and rotation axis 304. Alternatively, it should be understood that the shaft 306 may be fixed to the rotatable target plate 202 and one or more bearings or bushings secured to the fixed target body 204 such that the rotatable target plate 202 and shaft 306 rotate around the rotation axis 304 via the one or more bearings or bushings secured to the fixed target body 204. For the purposes of this disclosure, the shaft and bearing/bushing combination, which encompasses any shaft and bearing or bushing configuration in which the rotatable target plate 202 may be rotatably coupled to the fixed target body, will be referred to as the shaft and rotation mechanism 308. Accordingly, the shaft and rotation mechanism 308 may include one or more shafts and one or more bearings, bushings, or any device or mechanism for rotationally coupling the rotatable target plate 202 to the fixed target body 204. The shaft and rotation mechanism 308 may include one or more port 310 for injecting lubrication for the bearings.

According to various embodiments, the rotatable target plate 202 has a deflector plate 312 mounted to the shaft and rotation mechanism 308 at a downward angle. The deflector plate 312 ensures that any projectile or projectile pieces that could impact a surface of the shaft and rotation mechanism 308 and ricochet back toward the shooter will be deflected downward towards the ground. The deflector plate 312 may be manufactured from any material suitable for impact with bullets or projectiles, as discussed above with respect to the rotatable target plate 202 and the fixed target body 204. According to embodiments discussed herein with respect to FIGS. 13-16, the deflector plate 312 is created from a single sheet of material with the rotatable target plate 202 and the fixed target body 204 for any given gravity resetting range target 100.

According to various embodiments, the rotatable target plate 202 and corresponding target plate aperture 208 of each gravity resetting range target 100 has a substantially circular target portion beneath an elongated neck portion. The substantially circular target portion may have any desired diameter. The larger the diameter, the easier it is for the shooter to hit the rotatable target plate 202. Conversely, the smaller the diameter, the more difficult the shot needed to hit the rotatable target plate 202. According to various embodiments, the rotatable target plate 202 may be available in 6, 8, 10, and 12 inch diameters. With these embodiments, the corresponding target plate apertures 208 may be available in 6.5, 8.5, 10.5, and 12.5 inch diameters so that there is a minimal clearance of approximately a 0.25" gap between the edges of the rotatable target plate 202 and the edges of the fixed target body 204 that define the target plate aperture 208. The target plate apertures 208 may provide a minimal clearance that allows the rotatable target plate 202 to pass through a corresponding target plate aperture 208 without contacting the fixed target body 204. The minimal clearance may be small enough to prevent a projectile from passing between the rotatable target plate 202 and the fixed target body 204 without making contact. The example provided of approximately a 0.25" minimal clearance is for illustrative purposes and should not be considered as limiting.

It should be noted that the fixed target bodies 204 and the rotatable target plates 202 are not limited to those that are shown and described herein. For example, the fixed target bodies 204 and/or the rotatable target plates may be shaped to represent an animal, one or more vital organs, or any desired shape and configuration.

The material used for the rotatable target plate 202 and the fixed target body 204 may be any suitable thickness. The desired thickness depends on the material used, the distance of the shooter from the target, and the type of firearm or ammunition that will be used. For example, 0.25" AR500 steel may be suitable for up close speed drills with a handgun, while 0.375" AR500 steel may be appropriate for longer shots with a rifle. According to various embodiments, the material used for the rotatable target plate 202 and the fixed target body 204 may be AR500 steel in thicknesses of 0.125", 0.25", 0.375", and 0.5".

Figure 4:
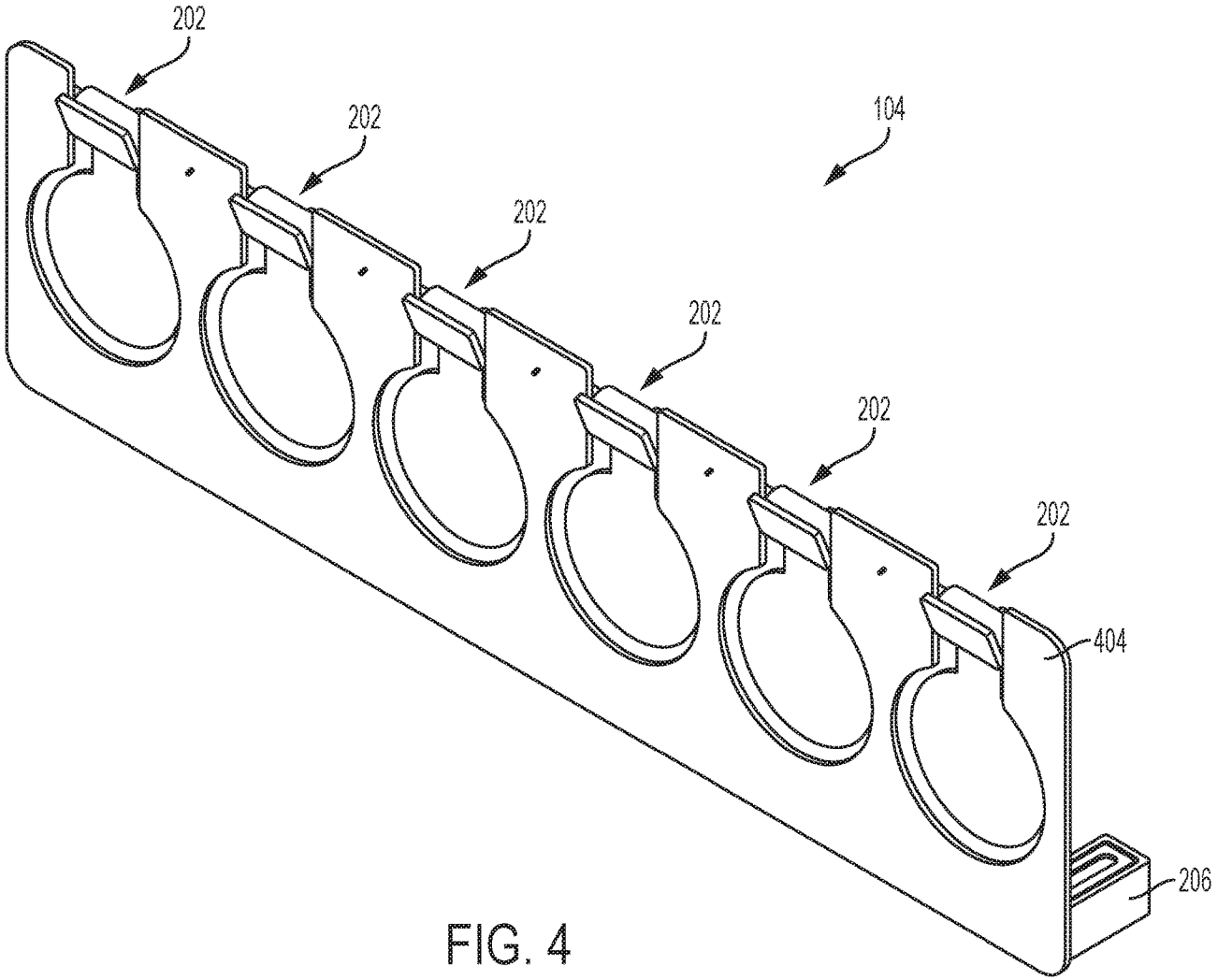
FIG. 4 is a perspective view of a plate rack target according to various embodiments described herein.

The shape of the fixed target body 204 of the plate target 102 of FIG. 2 is substantially rectangular encompassing a total of one target plate aperture 208 and one rotatable target plate 202. FIG. 4 shows an embodiment corresponding to a rack target 104 in which the fixed target body 204 is configured as a rack frame body 404. The rack frame body 404 is substantially rectangular encompassing a total of six rotatable target plates 202. It should be clear that any number of rotatable target plates 202 may be utilized without departing from the scope of this disclosure. As with the plate target 102 described above, the rack target 104 is configured as a portable range target. A bracket 206 may be secured to the fixed target body 204 to secure the plate target 102 to a base. The bracket 206 is configured to engage a metal, wood, composite, or other type of post, which engages a corresponding bracket 206 of the base. In this manner, the rack target 104 may be disassembled for transport, creating a portable range target that is easily transported, assembled, and disassembled by a user.

Figure 5:
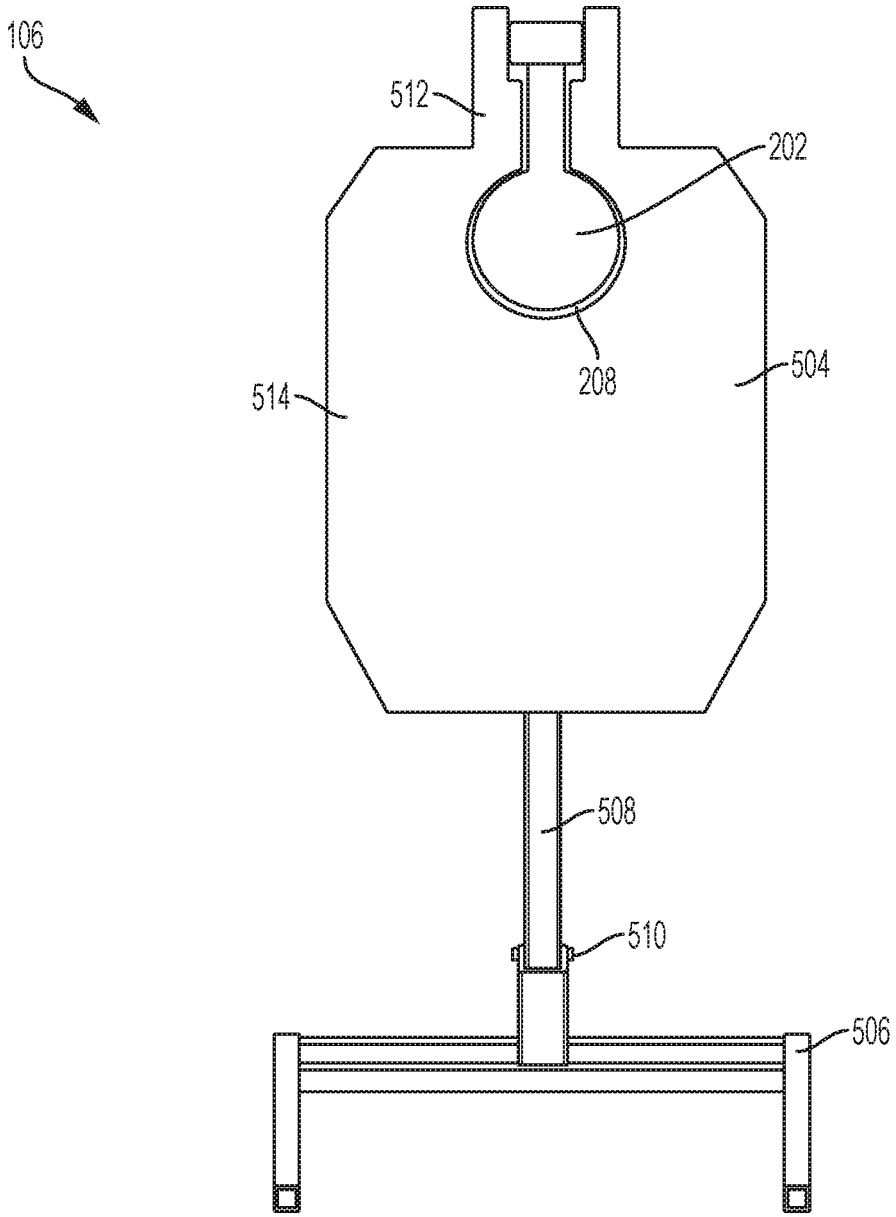
FIG. 5 is a front view of a torso frame target according to various embodiments described herein.

Turning now to FIG. 5, the torso frame target 106 is shown. The torso frame target 106 includes a rotatable target plate 202 encompassed within a target plate aperture 208 of a fixed target body 204 that is configured as a torso frame body 504. The torso frame body 504 includes a head portion 512 and a body portion 514. The rotatable target plate 202 has a substantially circular portion positioned below the head portion 512 and within the body portion 514 of the torso frame body 504. The torso frame body 504 is shown mounted to a base 506. The base 506 can be made of any suitable material and have any shape and configuration. The base 506 should support the torso frame target 106 in a manner that provides a stable target in a desired position with minimal swaying or movement. According to various embodiments, the base 506 may be made from hollow metal tubing that is of sufficient strength to adequately support the torso frame target 106 while minimizing weight so that one person is capable of transporting the base 506 to a desired location and assembling the torso frame target 106 and base 506. According to another embodiment, the base 506 is cut from a flat plate and is assembled using tabs or other releasable connection mechanism.

The torso frame target 106 is coupled to the base 506 by a metal, wood, composite, or other type of post 508. According to one embodiment, the post 508 is a 2×4 inch length of wood. By using a common type of lumber, a replacement posts are readily available when the post 508 is destroyed or weakened from impact with stray shots. Moreover, the 2×4 inch length of wood may be readily cut to a desired length. In this manner, the height of the torso frame target 106, as well as any of the gravity resetting range targets 100 described herein, is easily customizable by a user. The post 508 may be secured to the base 506 by fasteners 510, such as bolts, screws, or a threaded T-handle as described below with respect to FIG. 8.

High Visibility Hit Indicators

Figure 6:
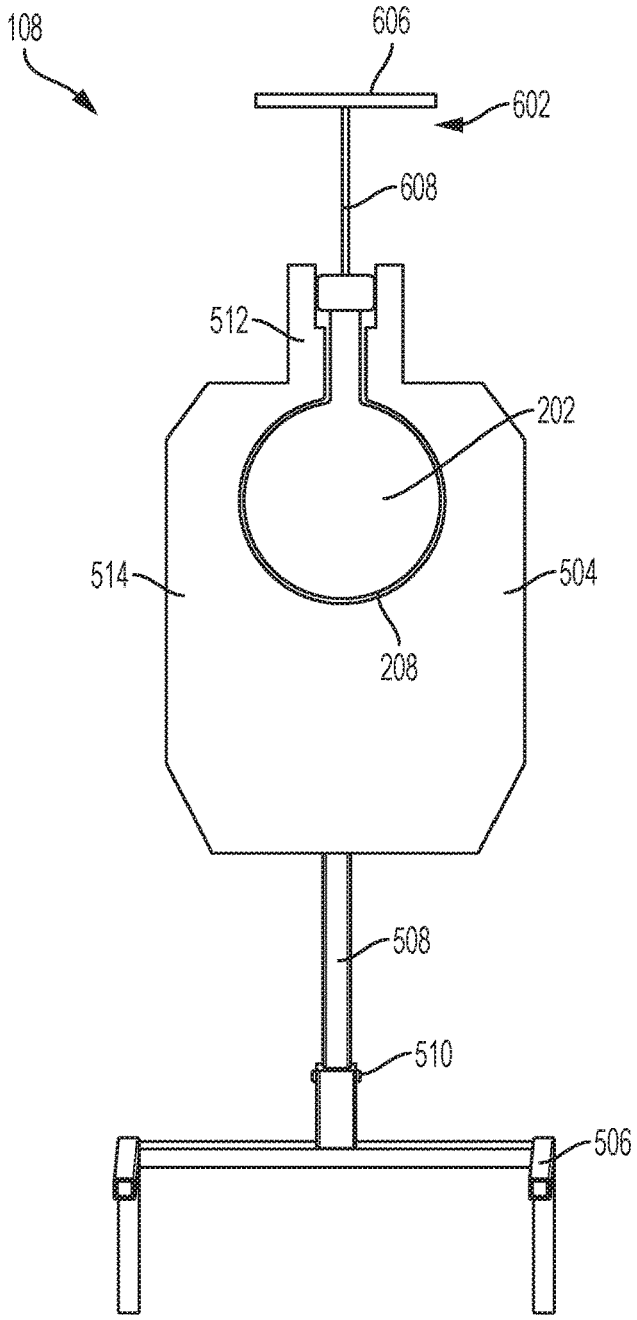
FIG. 6 is a front view of a long-range torso frame target according to various embodiments described herein.

As mentioned above, when shooting range targets at extreme distances, a shooter may have trouble determining whether or not a shot hit the intended target without using optics or a spotter with optics. FIG. 6 shows a front view of a long-range torso frame target 108. The long-range torso frame target 108 provides a long-range hit indicator 602 extending above the rotatable target plate 202 that spins with the rotatable target plate 202 when the target plate is struck by a projectile to create a high visibility hit indication. The long-range hit indicator 602 includes a long-range hit indicator plate 606 that is coupled to the rotatable target plate 202 via a long-range hit indicator arm 608.

Figure 7A:
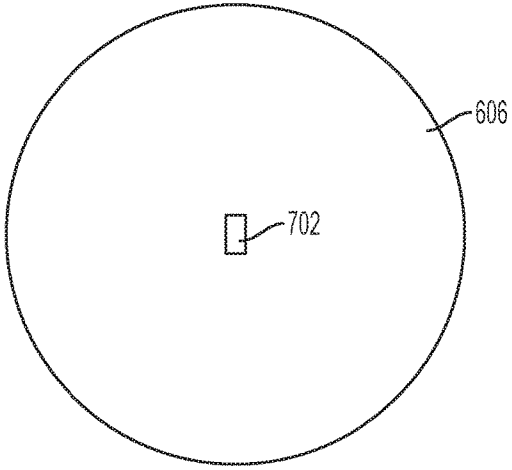
FIG. 7A is a top view of a long-range hit indicator plate according to various embodiments described herein.
Figure 7B:
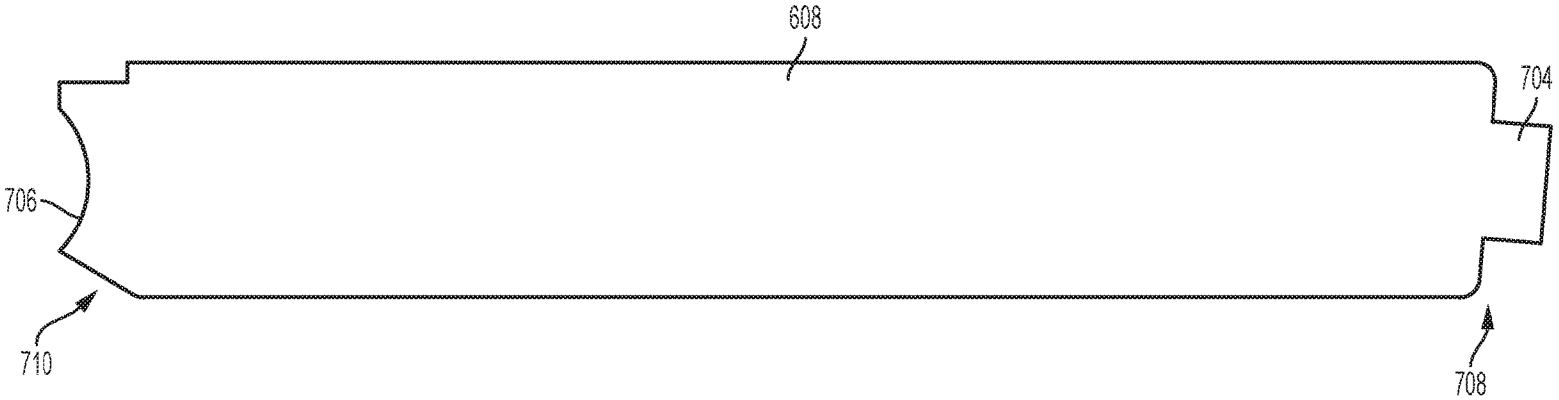
FIG. 7B is a side view of a long-range hit indicator arm according to various embodiments described herein.

The long-range hit indicator plate 606 is shown in FIG. 7A. According to this illustrative example, the long-range hit indicator plate 606 is circular and includes a mounting aperture 702 in the center of the plate. Alternatively, the long-range hit indicator plate 606 may be any shape or configuration. FIG. 7B shows an example of a long-range hit indicator arm 608. It should be understood that the long-range hit indicator plate 606 and the long-range hit indicator arm 608 of FIGS. 7A and 7B, respectively, are not drawn to scale with respect to one another. For example, the long-range hit indicator arm 608 is enlarged as compared to the long-range hit indicator plate 606 to clearly show the various features of the component.

The long-range hit indicator arm 608 includes a proximal end 710 that is configured to be coupled to the shaft and rotation mechanism 308 of the rotatable target plate 202, and a distal end 708 opposite the proximal end 710 that is configured to be coupled to the long-range hit indicator plate 606. The proximal end 710 has a curved edge 706 that is shaped according to the curvature of the shaft and rotation mechanism 308. The curved edge 706 is secured to the shaft and rotation mechanism 308 using fasteners, welding, adhesive, or any other suitable method of fixing the long-range hit indicator 602 to the rotatable target plate 202. According to one embodiment, the long-range hit indicator arm is secured to the shaft and rotation mechanism 308 at approximately 180 degrees from the rotatable target plate 202. Doing so ensures that gravity will act on the heavier rotatable target plate 202 to reset the rotatable target plate 202 in a ready position that is directly under the shaft and rotation mechanism 308. However, the long-range hit indicator arm 608 may be coupled to the shaft and rotation mechanism 308 at an angle other than 180 degrees from the rotatable target plate 202 if it were desirable to alter the center of gravity of the long-range hit indicator 602 and rotatable target plate 202 to alter the positioning of the rotatable target plate 202 when reset and ready for a shot. The distal end 708 of the long-range hit indicator arm 608 includes a projection 704 that is sized and shaped to engage the mounting aperture 702 of the long-range hit indicator plate 606. After inserting the projection 704 into the mounting aperture 702 during assembly, the long-range hit indicator plate 606 and the long-range hit indicator arm 608 may be secured together using fasteners, welding, adhesive, or any other suitable method of fixedly coupling the two components together.

Figure 9:
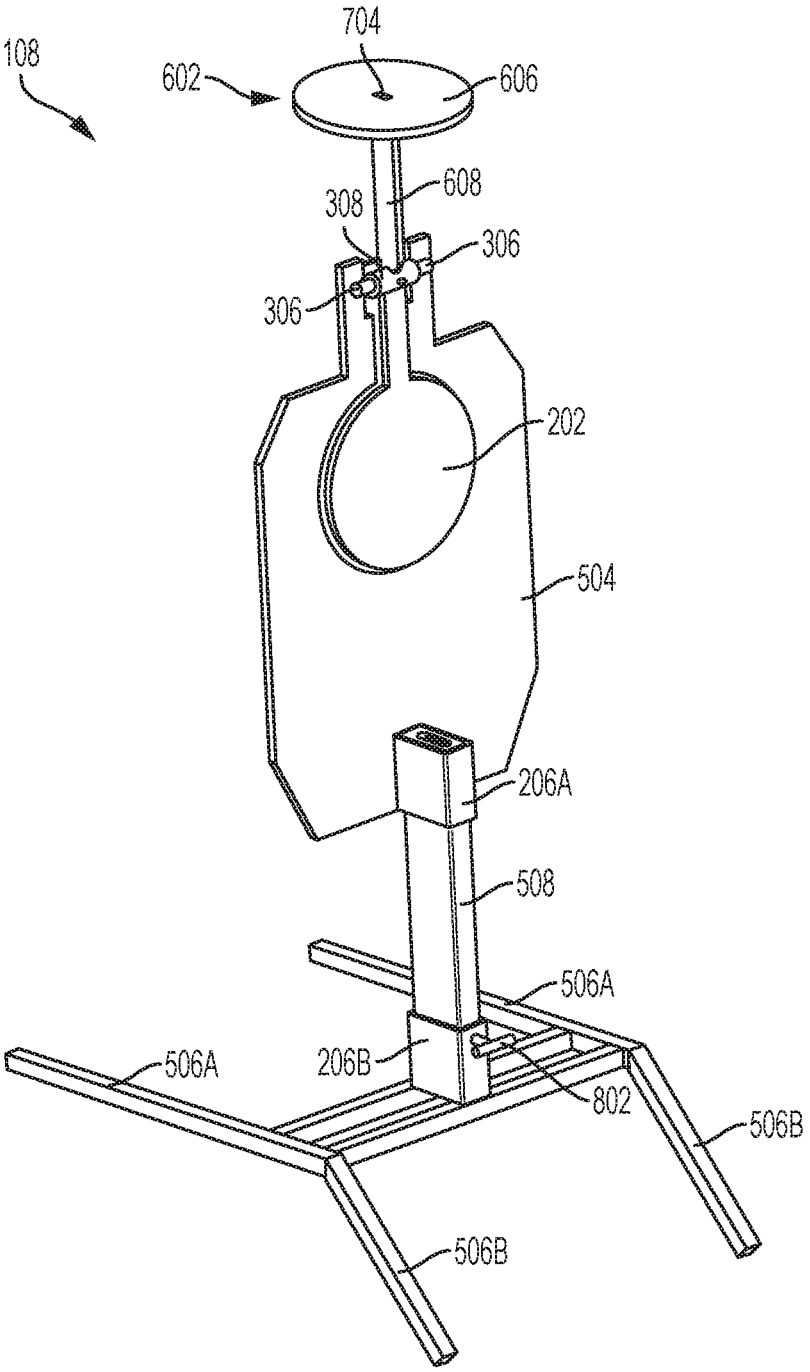
FIG. 9 is a rear perspective view of a long-range torso frame target according to various embodiments described herein.

FIGS. 8 and 9 show side and rear perspective views, respectively, of the long-range torso frame target 108 according to various embodiments. These views show additional details with respect to the configuration of the long-range hit indicator 602, as well as to the the base 506 and associated assembly of the long-range torso frame target 108. As seen in these figures, the long-range hit indicator arm 608 and the rotatable target plate 202 are substantially linearly aligned on opposing sides of the shaft and rotation mechanism 308. The long-range hit indicator plate 606 is configured within a plane that is substantially normal to a plane parallel to a front surface 302 (FIG. 3) of the rotatable target plate 202. This alignment and positioning of the components of the long-range torso frame target 108 provide enhanced visibility of the rotation of the rotatable target plate 202 resulting from a successful shot, as well as providing for gravity resetting of the rotatable target plate 202 without further action from the shooter. The functionality of the long-range hit indicator 602 and rotatable target plate 202 will demonstrated with respect to FIGS. 10-12 below.

The torso frame body 504 is attached to the base 506 using the post 508, which may be a length of lumber or made from any other suitable material. Using a 2×4 length of wood as an example, one end of the wood post is inserted into the bracket 206A attached to the torso frame body 504 and the other end of the wood post is inserted into the bracket 206B attached to the base 506. A threaded T-handle 802 is screwed into the bracket 206B and into the post 508 to secure it within the base. A similar T-handle (not shown) may be used with respect to the bracket 206A.

The base 506 includes front legs 506A and rear legs 506B. The front legs 506A and the rear legs 506B are configured to position the torso frame body 504 at a forward angle such that the long-range torso frame target 108 is effectively leaning forward toward the shooter. Doing so provides a safety feature in which the torso frame body 504 deflects projectiles downward to the ground rather than back toward the shooter.

Figure 10:
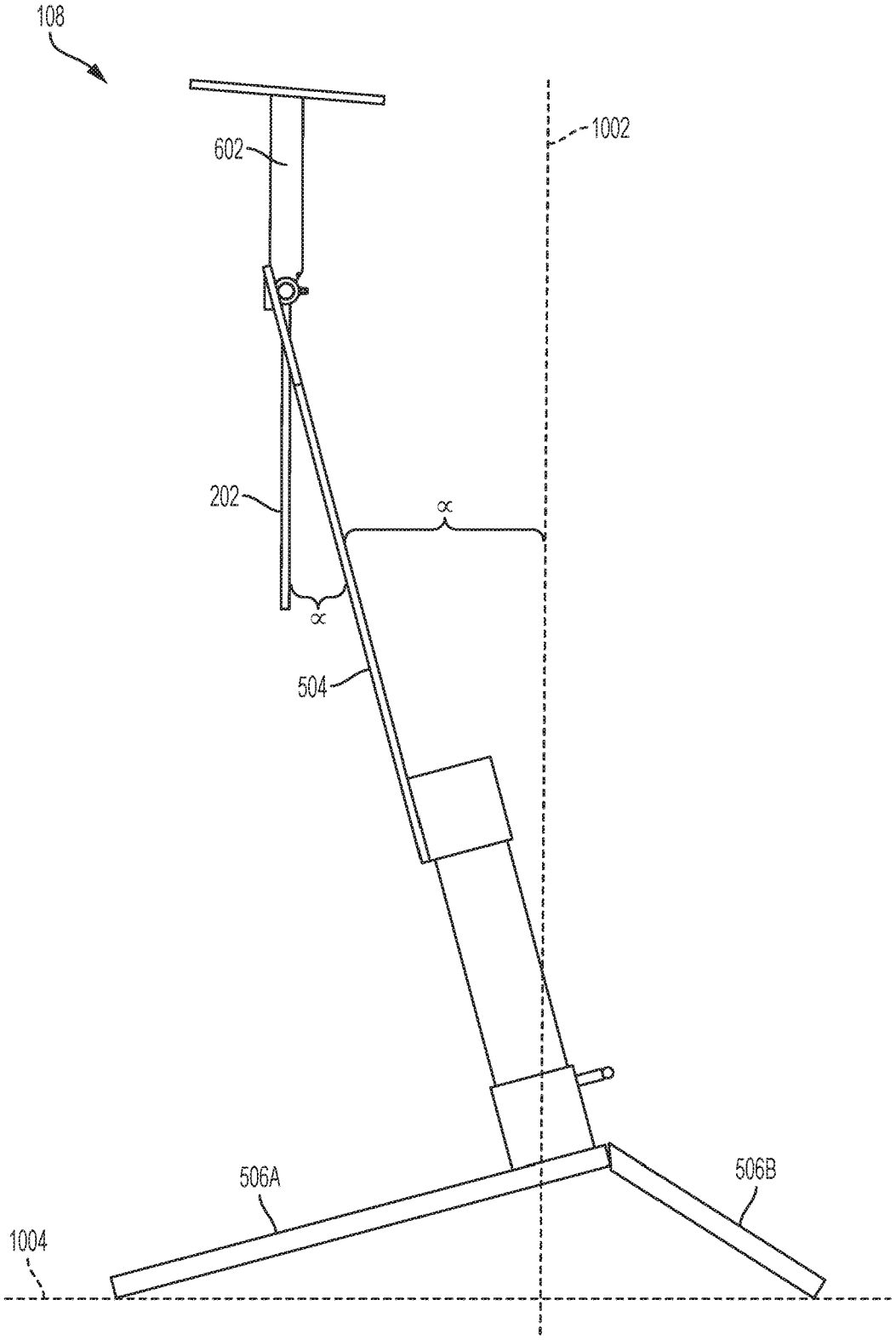
FIG. 10 is a side view of a long-range torso frame target with the target plate in a reset position according to various embodiments described herein.

In FIGS. 8 and 9, the long-range hit indicator arm 608 and the rotatable target plate 202 are shown aligned with the torso frame body 504. However, in practice, the long-range hit indicator arm 608 and the rotatable target plate 202 will remain substantially parallel to a vertical plane 1002 when at rest, as shown in FIG. 10. According to various embodiments, the size of the rotatable target plate 202 is larger than the size of the long-range hit indicator 602. The resulting increased weight of the rotatable target plate 202 as compared to the lighter weight of the long-range hit indicator 602 biases the rotatable target plate 202 in a reset position below the shaft and rotation mechanism 308 with the long-range hit indicator 602 above the shaft and rotation mechanism 308.

As shown in FIG. 10, the torso frame body 504 is configured at an angle α from the vertical plane 1002. When at rest, the long-range hit indicator arm 608 and the rotatable target plate 202 will remain substantially parallel to a vertical plane 1002, or at the angle α from the torso frame body 504. Similarly, the long-range hit indicator plate 606 is configured within a plane that is substantially normal to the vertical plane 1002, or parallel to a horizontal plane 1004. When the rotatable target plate 202 is impacted by a projectile, the rotatable target plate 202 will rotate backwards through the target plate aperture 208, 360 degrees around the shaft and rotation mechanism 308, and continuing until the gravity force acting on the rotatable target plate 202 returns the rotatable target plate 202 to the reset position at rest below the shaft and rotation mechanism 308.

Figure 11:
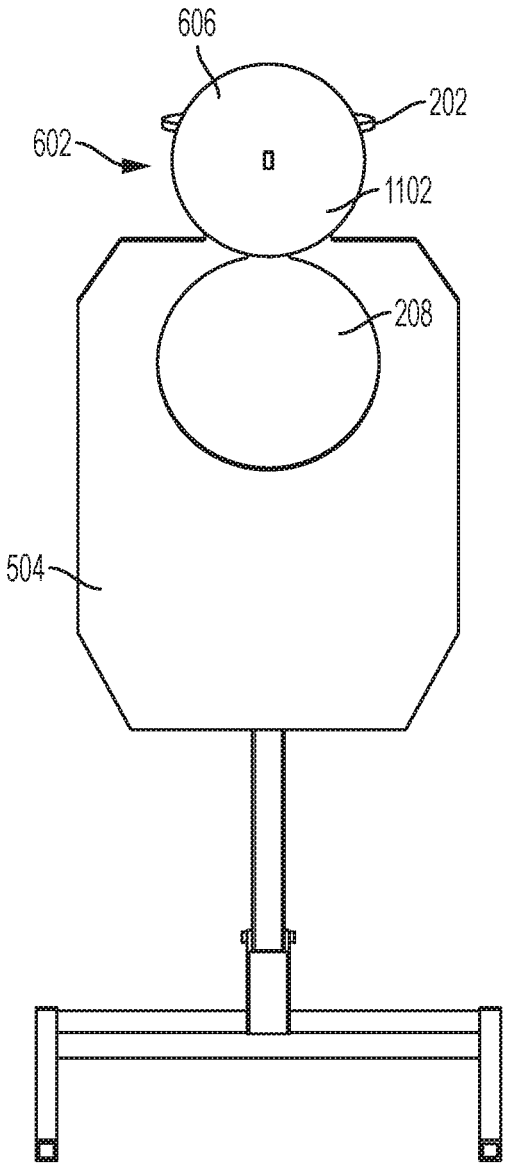
FIG. 11 is a front view of a long-range torso frame target with a long-range hit indicator rotated to a visible position according to various embodiments described herein.
Figure 12:
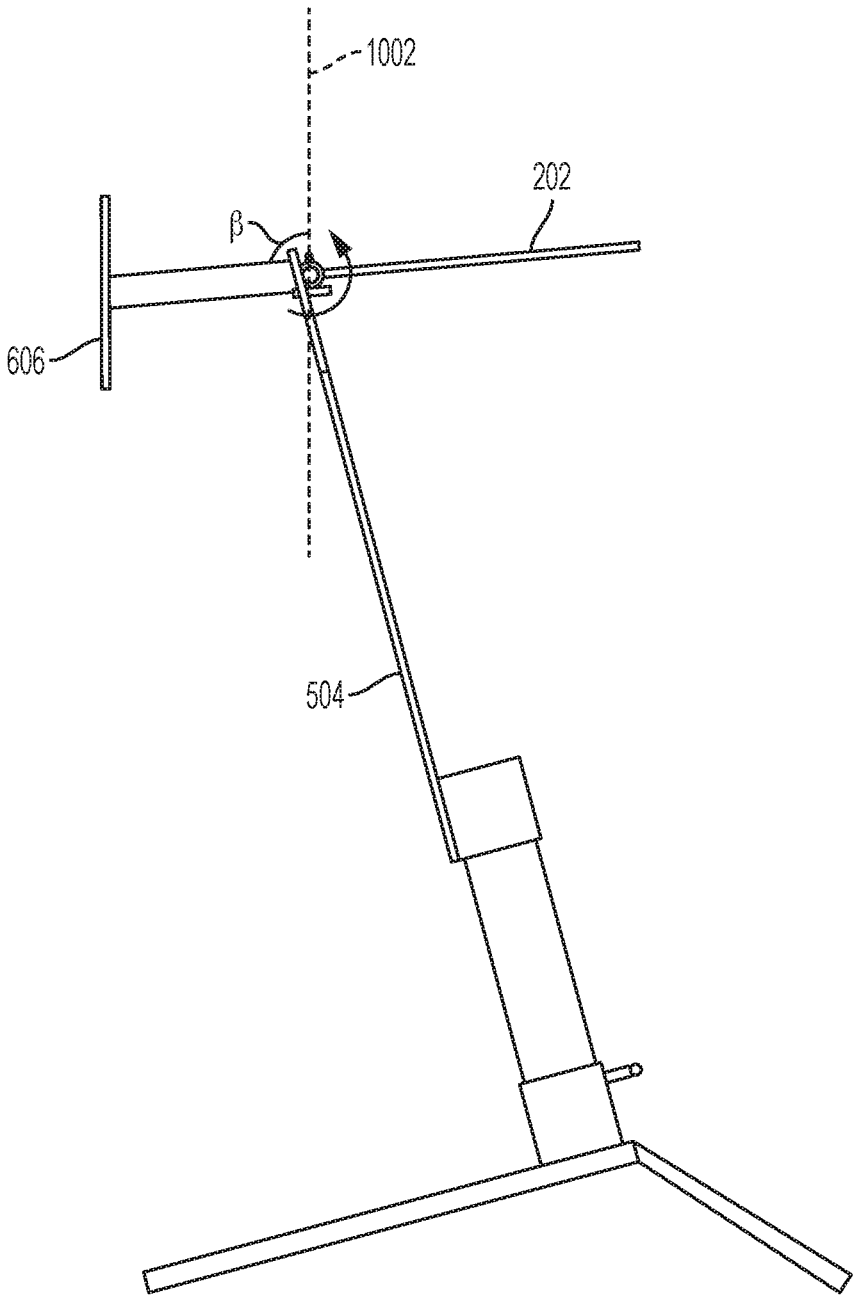
FIG. 12 is a side view of the long-range torso frame target of FIG. 11 according to various embodiments described herein.

FIGS. 11 and 12 show front and side views, respectively, of the long-range hit indicator plate 606 and the rotatable target plate 202 after rotating an angle with respect to the vertical plane 1002 after impact of a projectile with the rotatable target plate 202. In this example, the angle β is approximately 90 degrees. In this position, a top surface 1102 of the long-range hit indicator plate 606 is fully visible to a shooter standing in front of the long-range torso frame target 108 while the front surface 302 of the rotatable target plate 202 is not visible. As the long-range hit indicator plate 606 and the rotatable target plate 202 rotate around the shaft and rotation mechanism 308, the top surface 1102 of the long-range hit indicator plate 606 and the front surface 302 of the rotatable target plate 202 sequentially alternate in visibility to the shooter. In other words, the shooter will see the long-range hit indicator plate 606, then the rotatable target plate 202, then the long-range hit indicator plate 606 again, and so forth until the rotation slows and stops due to gravity and other forces acting on the rotating components.

According to various embodiments, the top surface 1102 of the long-range hit indicator plate 606 includes a high-visibility feature that visually distinguishes the long-range hit indicator plate 606 from the front surface 302 of the rotatable target plate 202 so that a successful shot will be easily visualized as the long-range hit indicator plate 606 repeatedly appears and disappears from the shooter's view. As an example, according to one embodiment, the top surface 1102 of the long-range hit indicator plate 606 is painted red, while the front surface 302 of the rotatable target plate 202 is painted white. After a successful shot, the rotating and alternating red and white colors are highly visible, enabling the shooter to receive feedback of the successful shot without the need for optics. It should be appreciated that the high-visibility feature or other distinguishing features may include any color, lights, audible devices, or any other feature that highlights or enhances the motion of the long-range hit indicator plate 606 and the rotatable target plate 202.

According to various embodiments, the characteristics of the long-range hit indicator 602 and rotatable target plate 202 may be selected according to the desired positioning of the center of gravity of these rotatable components. For example, selecting a rotatable target plate 202 with a smaller diameter decreases the weight of the rotatable target plate 202, shifting the center of gravity upwards toward the shaft and rotation mechanism 308. Increasing the diameter of the long-range hit indicator plate 606 would have the same effect. Shifting the center of gravity upwards toward the shaft and rotation mechanism 308 facilitates rotation. Projectiles of shots taken from a long range do not impact the target as forcefully as projectiles of shots taken at close range. Accordingly, selecting characteristics of the long-range hit indicator 602 or of the rotatable target plate 202 to facilitate rotation provides a benefit in terms of being able to more easily visualize successful shots due to the increased rotation of the long-range hit indicator 602.

Manufacturing from a Single Sheet of Material

As discussed briefly above, embodiments provide for the manufacturing of the components of the gravity resetting range targets 100 from a single sheet or piece of material. Conventionally, a sheet of metal may be used to stamp or cut a number of the same circular targets or target components. For the purposes of this disclosure, the term "cut" may be used to refer to any method of removing a piece of material having a desired shape and size from a larger piece of material. This process may include cutting using mechanical tools, heat, water, pressure, may include stamping the material, or any other suitable manufacturing techniques.

Cutting numerous uniquely shaped components from a sheet of material may result in substantial waste material since it may not be possible or practical to arrange the uniquely shaped components so that they abut one another at all edges on the sheet of material. As a result, an undesirable quantity of waste material may remain after cutting the components out of the material. Moreover, after cutting the numerous components from the material, the separated components must be stored in an efficient manner.

Figure 13:
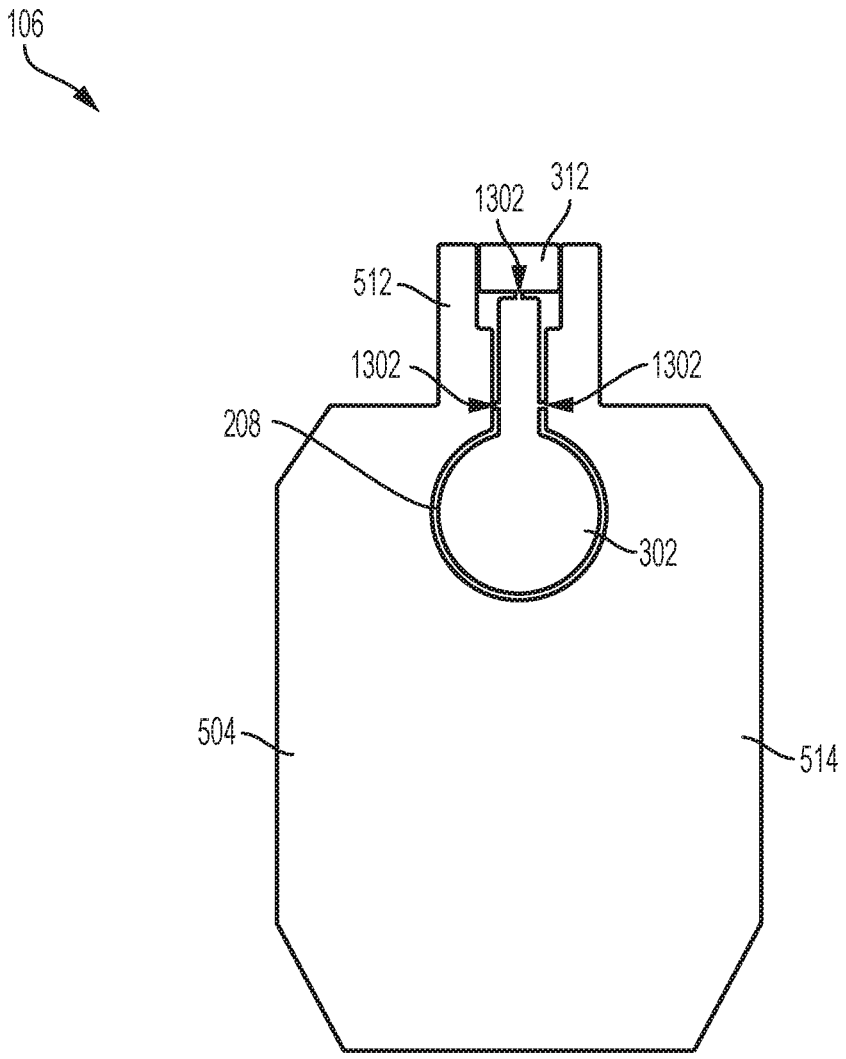
FIG. 13 is a front view of a torso frame body and rotatable target plate cut from a single piece of material with connection tabs in place according to various embodiments herein.
Figure 14:
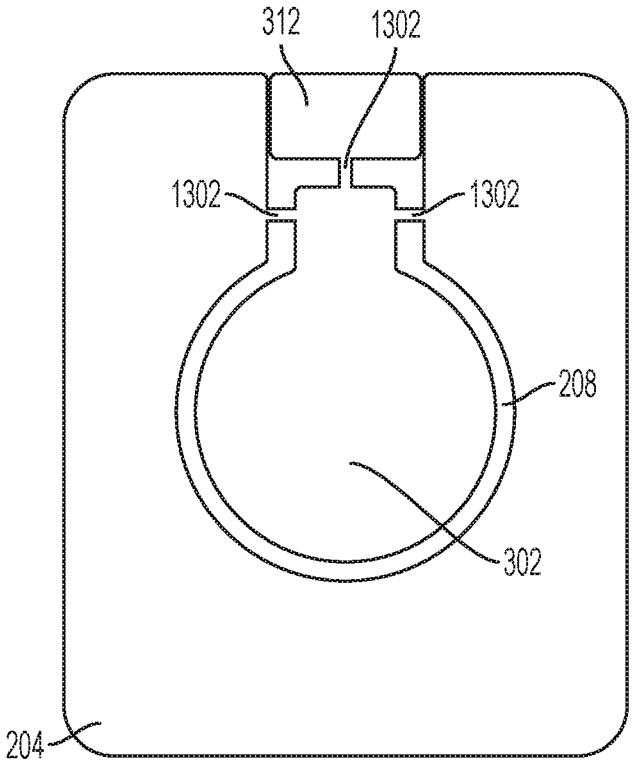
FIG. 14 is a front view of a fixed target body of a single plate target with the rotatable target plate cut from a single piece of material with connection tabs in place according to various embodiments herein.

According to various embodiments, the rotatable target plates 202 are cut from the same sheet of material as the fixed target body 204. The rotatable target plates 202 are cut by cutting the target plate aperture 208 from the fixed target body 204, leaving at least one tab. FIGS. 13 and 14 show examples of fixed target bodies cut from a sheet of material, such as AR500 steel. As seen, the target plate apertures 208 are cut around the rotatable target plates 202 according to the desired minimal clearance. Tabs 1302 hold the rotatable target plates 202 in place within the target plate apertures 208. Similarly, the deflector plates 312 are cut from the fixed target bodies 204 and held in place with tabs 1302. It should be appreciated that while three tabs 1302 are shown, any number and positioning of the tabs 1302 may be used without departing from the scope of this disclosure. By cutting the sheets of AR500 steel, or other suitable material, in this manner, most of the components of the gravity resetting range targets 100 may be cut from a single sheet of material with a substantially rectangular footprint (corresponding to the fixed target bodies 204) that allow the fixed target bodies 204 to abut one another on the single sheet of material, which minimizes waste material between targets once the sheet is cut.

Moreover, by maintaining the rotatable target plates 202 and the deflector plates 312 in place within the fixed target bodies 204 using tabs, the fixed target bodies 204 with the connected components may be efficiently and compactly stacked and stored prior to shipping, sale, assembly, and use. The compact and stackable configuration of the components secured within the fixed target bodies 204 saves storage space and shipping containers, which corresponds to reduced costs.

Figure 15:
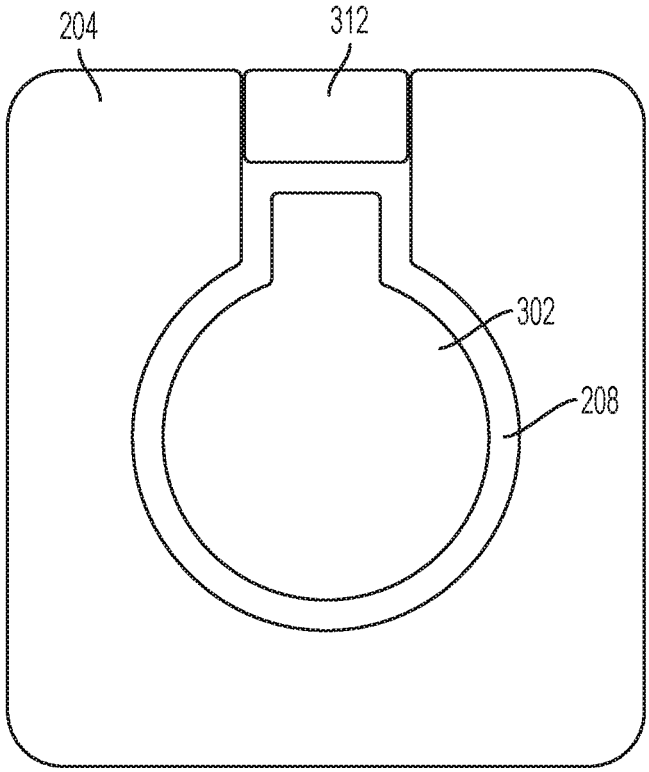
FIG. 15 is a front view of a fixed target body of a single plate target with the rotatable target plate cut from a single piece of material with connection tabs removed according to various embodiments herein.
Figure 16:
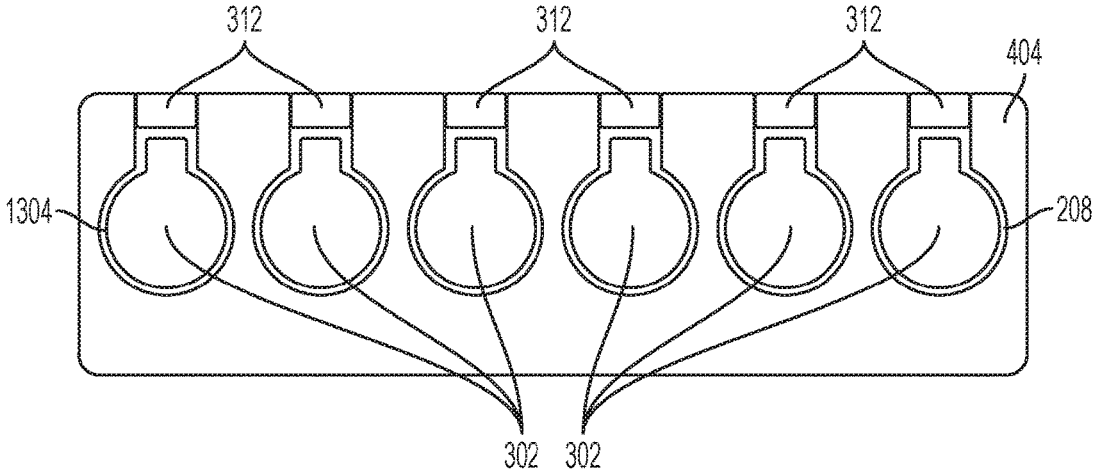
FIG. 16 is a front view of a fixed target body of a plate rack target with the rotatable target plates cut from a single piece of material with connection tabs removed according to various embodiments herein.

Prior to assembly, the tabs 1302 are cut to remove the rotatable target plate 202 and deflector plate 312 from the target plate aperture 208 of the fixed target body 204. FIGS. 15 and 16 show examples of fixed target bodies and corresponding target components cut from a single sheet of material after cutting the tabs 1302. The rotatable target plates 202 and deflector plates 312 may now be removed from the target plate apertures 208, combined with shaft and rotation mechanisms 308, and assembled within the target plate apertures 208 from which they were originally cut.

Figure 17:
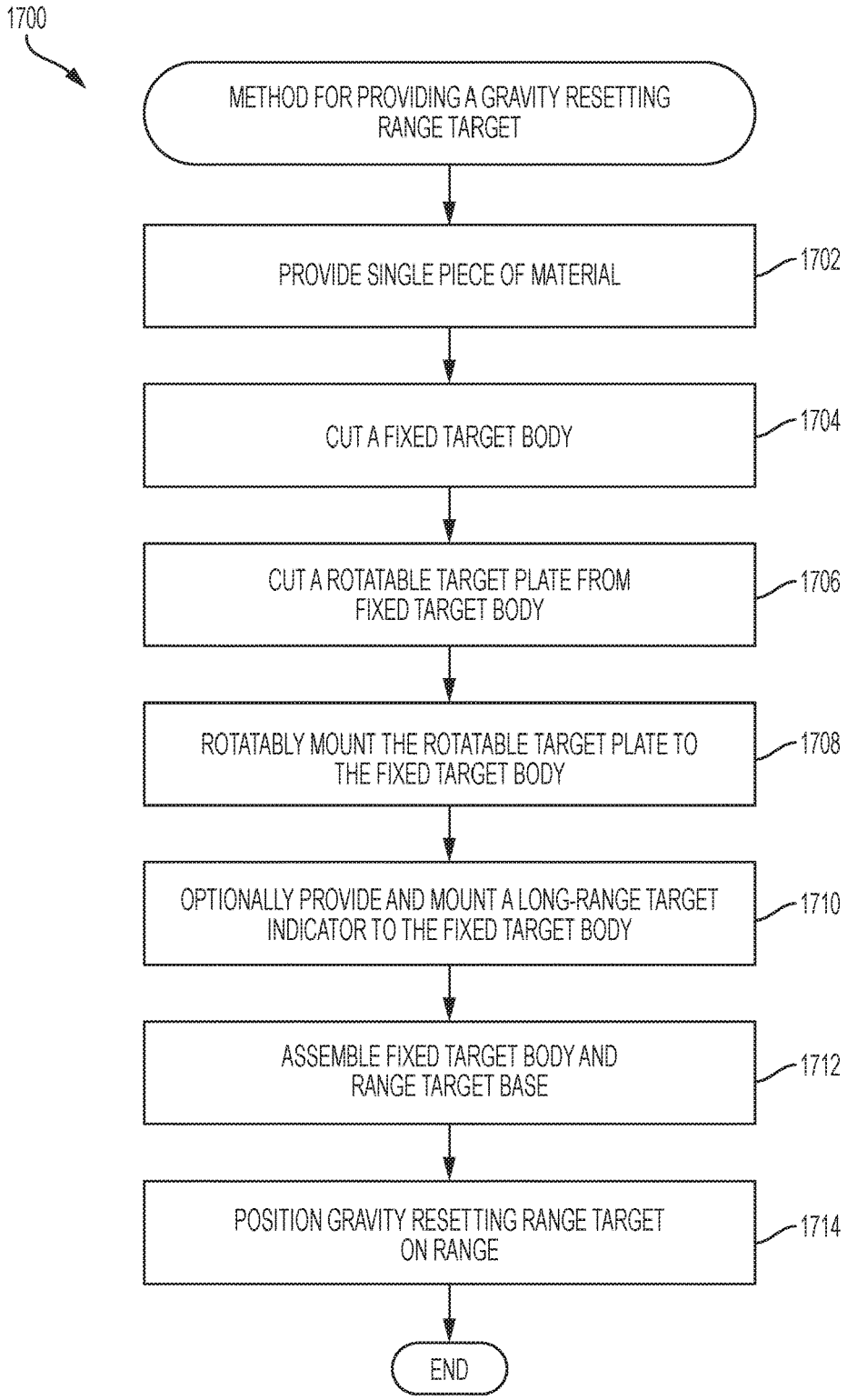
FIG. 17 is a flow diagram of a method for providing a gravity resetting range target according to various embodiments described herein.

FIG. 17 illustrates a routine 1700 for providing a gravity resetting range target 100 according to at least one embodiment disclosed herein. Unless otherwise indicated, more or fewer operations may be performed than shown in the figures and described herein. Additionally, unless otherwise indicated, these operations may also be performed in a different order than those described herein.

The routine 1700 starts at operation 1702, where a single piece of material, such as AR500 steel, is provided. At operation 1704, the fixed target body 204 is cut from the single piece of material. A rotatable target plate 202 is cut from the fixed target body 204, leaving one or more tabs 1302 in place at operation 1706. It should be understood that the rotatable target plate 202 may be cut prior to the fixed target body 204. Operation 1704 may additionally include cutting a deflector plate 312 from each fixed target body 204 as described above. In cutting the rotatable target plate 202 and deflector plate 312, the target plate aperture 208 is created according to a desired size to create a minimal clearance between the rotatable target plate 202 and the fixed target body 204.

After any storage of the fixed target bodies 204 and connected components, the tabs 1302 are cut and at operation 1708, the rotatable target plate 202 is rotatably mounted to the fixed target body 204 using a shaft and rotation mechanism 308. At operation 1710, a long-range hit indicator 602 is optionally mounted to the fixed target body via the shaft and rotation mechanism 308. The long-range hit indicator 602 may be added to any gravity resetting range target 100 if the target is to be used for long-range shooting.

At operation 1712, the fixed target body 204 with attached rotatable target plate 202 and long-range hit indicator 602, if applicable, is mounted to a base 506. As described above, the base 506 is configured to releasably connect to the fixed target body 204 and support the fixed target body 204 at an angle $\alpha$ with respect to a vertical plane 1002. To mount the fixed target body 204 to the base 506, a post 508 may be inserted into corresponding brackets 206A and 206B and secured using a T-bracket 802 or other fasteners 510. At operation 1714, the assembled gravity resetting range target 100 is positioned at the desired location on the firing range and the target is ready for use.

Based on the foregoing, it should be appreciated that technologies for resetting range targets with high visibility hit indicators are provided herein. The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A gravity resetting range target, comprising:

a fixed target body comprising a torso frame body having a head portion, a body portion, and a target plate aperture, the target plate aperture comprising a substantially circular portion positioned below the head portion and within the body portion of the torso frame body;

a rotatable target plate comprising a substantially circular portion according to the target plate aperture and rotatably coupled to the fixed target body such that the rotatable target plate is configured to rotate around a rotation axis extending through the fixed target body;

a shaft and rotation mechanism coupling the rotatable target plate to the fixed target body; and a long-range hit indicator configured to rotate in conjunction with the rotatable target plate and to provide a high visibility indicator to a shooter that the rotatable target plate is rotating, the long-range hit indicator comprising:

a long-range hit indicator arm having a proximal end coupled to the shaft and rotation mechanism and a distal end opposite the proximal end; and a long-range hit indicator plate coupled to the distal end of the long-range hit indicator arm.

2. The gravity resetting range target of claim 1, wherein the rotation axis is substantially horizontal such that the rotation axis is substantially parallel with the ground, and wherein the rotatable target plate is configured to rotate 360 degrees around the rotation axis.

3. The gravity resetting range target of claim 2, wherein the rotatable target plate is configured to pass through the target plate aperture as the rotatable target plate rotates around the rotation axis.

4. The gravity resetting range target of claim 1, wherein the fixed target body comprises a front surface that is substantially planar and is positioned at an angle with respect to a vertical plane.

5. The gravity resetting range target of claim 4, wherein the angle comprises approximately 20 degrees.

6. The gravity resetting range target of claim 1, wherein the fixed target body comprises a total of one target plate aperture and one rotatable target plate.

7. The gravity resetting range target of claim 1, wherein the long-range hit indicator arm and the rotatable target plate are substantially linearly aligned.

8. The gravity resetting range target of claim 7, wherein the long-range hit indicator plate is configured within a plane that is substantially normal to a plane comprising a front surface of the rotatable target plate.

9. The gravity resetting range target of claim 8, wherein an indicator surface of the long-range hit indicator plate comprises a high visibility feature that visually distinguishes the indicator surface of the long-range hit indicator plate from the front surface of the rotatable target plate.

10. The gravity resetting range target of claim 8, wherein the rotatable target plate comprises a first weight, wherein the long-range hit indicator arm and the long-range hit indicator plate comprise a second weight, and wherein the first weight is greater than the second weight such that a gravity force will act on a spinning rotatable target plate and long-range hit indicator to reset the rotatable target plate in a position below the shaft and rotation mechanism.

11. The gravity resetting range target of claim 1, wherein the target plate aperture is created by cutting the rotatable target plate from the fixed target body using a single piece of material.

12. A method for providing a gravity resetting range target, the method comprising:

providing a single piece of material;

cutting a fixed target body from the single piece of material, the fixed target body comprising a torso frame body having a head portion and a body portion;

cutting a rotatable target plate comprising a substantially circular portion from the fixed target body to create a target plate aperture having a shape and size that allows for a minimal clearance between the rotatable target plate and the fixed target body when the rotatable target plate is positioned within the target plate aperture, wherein the target plate aperture comprises a substantially circular portion positioned below the head portion and within the body portion of the torso frame body;

rotatably mounting the rotatable target plate to the fixed target body utilizing a shaft and rotation mechanism such that the rotatable target plate is configured to rotate around a rotation axis extending through the fixed target body and through the target plate aperture in response to receiving an impact with a projectile, and rotatably mounting a long-range hit indicator to the fixed target body opposite the rotatable target plate such that the long-range hit indicator is configured to rotate around the rotation axis substantially 180 degrees from the rotatable target plate, wherein rotatably mounting the long-range hit indicator to the fixed target body comprises mounting a long-range hit indicator arm at a proximal end to a shaft and rotation mechanism coupled to the rotatable target plate, and mounting a long-range hit indicator plate to a distal end of the long-range hit indicator arm such that the long-range hit indicator plate is configured within a plane that is substantially normal to a plane comprising a front surface of the rotatable target plate.

13. The method of claim 12, wherein cutting the rotatable target plate comprising a substantially circular portion from the fixed target body to create the target plate aperture having the shape and size that allows for the minimal clearance between the rotatable target plate and the fixed target body when the rotatable target plate is positioned within the target plate aperture comprises cutting around the rotatable target plate according to the minimal clearance and leaving at least one tab securing the rotatable target plate secured inside the target plate aperture of the fixed target body, the method further comprising:

cutting the at least one tab to remove the rotatable target plate from the target plate aperture of the fixed target body prior to rotatably mounting the rotatable target plate to the fixed target body.

14. The method of claim 13, further comprising:

stacking the rotatable target plate and fixed target body having the at least one tab securing the rotatable target plate inside the target plate aperture of the fixed target body among a plurality of rotatable target plates and fixed target bodies for storage; and removing the rotatable target plate and fixed target body having the at least one tab securing the rotatable target plate inside the target plate aperture of the fixed target body from storage prior to cutting the at least one tab.

15. The method of claim 12, wherein cutting a rotatable target plate having a first weight from the fixed target body comprises cutting the rotatable target plate from the fixed target body, and wherein rotatably mounting the long-range hit indicator to the fixed target body comprises rotatably mounting the long-range hit indicator having a second weight smaller than the first weight to the fixed target body such that a gravity force will act on a spinning rotatable target plate and long-range hit indicator to reset the rotatable target plate in a position below the shaft and rotation mechanism.

16. A method for providing a shooter with a target and shot feedback, the method comprising:

providing a fixed target body comprising a torso frame body having a head portion, a body portion, and a target plate aperture, the target plate aperture comprising a substantially circular portion positioned below the head portion and within the body portion of the torso frame body;

providing a rotatable target plate comprising a substantially circular portion according to the target plate aperture and rotatably coupled to the fixed target body utilizing a shaft and rotation mechanism such that the rotatable target plate is configured to rotate around a rotation axis extending through the fixed target body; and providing a long-range hit indicator configured to rotate in conjunction with the rotatable target plate and to provide a high visibility indicator to a shooter that the rotatable target plate is rotating, the long-range hit indicator comprising:

a long-range hit indicator arm having a proximal end coupled to the shaft and rotation mechanism and a distal end opposite the proximal end; and a long-range hit indicator plate coupled to the distal end of the long-range hit indicator arm.

17. The method of claim 16, wherein providing the fixed target body comprising a torso frame body having the head portion, the body portion, and the target plate aperture and providing the rotatable target plate comprising the substantially circular portion according to the target plate aperture comprises:

providing a single piece of material;

cutting the fixed target body from the single piece of material; and cutting the rotatable target plate from the fixed target body to create the target plate aperture having the shape and size that allows for a minimal clearance between the rotatable target plate and the fixed target body when the rotatable target plate is positioned within the target plate aperture.

18. The method of claim 16, further comprising providing a base configured to releasably connect to the fixed target body and support the fixed target body at an angle with respect to a vertical plane.

* * * * *